US006598434B2

(12) United States Patent
Yang

(10) Patent No.: US 6,598,434 B2
(45) Date of Patent: Jul. 29, 2003

(54) DUAL MECHANISM LOCK

(76) Inventor: Ping-Jan Yang, P.O. Box 26-757, Taipei (TW)

( * ) Notice: Subject to any disclaimer, the term of this patent is extended or adjusted under 35 U.S.C. 154(b) by 59 days.

(21) Appl. No.: 10/012,447

(22) Filed: Nov. 9, 2001

(65) Prior Publication Data

US 2003/0089147 A1 May 15, 2003

(51) Int. Cl.[7] ..... E05B 37/02

(52) U.S. Cl. ..... 70/213; 70/284; 70/285; 70/312

(58) Field of Search ..... 70/284, 285, 312, 70/213, 219, DIG. 71

(56) References Cited

U.S. PATENT DOCUMENTS 2,159,291 A * 5/1939 Quintal ..... 70/284
4,671,088 A * 6/1987 Jeang ..... 70/316 X
4,770,013 A * 9/1988 Nakai ..... 70/316 X
4,885,923 A * 12/1989 Nakai ..... 70/312 X
5,237,842 A * 8/1993 Rasch et al. ..... 70/285
5,345,798 A * 9/1994 Nakai ..... 70/312 X
5,661,991 A * 9/1997 Hsu ..... 70/312

FOREIGN PATENT DOCUMENTS

SU 881285 * 11/1981 ..... 70/284

* cited by examiner

*Primary Examiner*—Lloyd A. Gall

(57) ABSTRACT

A dual mechanism lock comprises a combination lock structure is disposed; a key lock having an internal cylinder and an external cylinder, and a fixing plate is embedded into a fixing groove on the external cylinder; the combination lock structure having a plurality of combination wheels pivotally coupled to the lock core rod connecting to the external cylinder; a spring is disposed between the other end of the lock core rod and the lock body; the internal cylinder is protruded from the panel and the panel is coupled to a knob; a sliding member is corresponsive to coupling and detachment of the inner groove of the external cylinder, and the lock core rod and the combination wheels control the coupling and detachment of the fixing plate and the external cylinder, or the key via the internal cylinder generates the movement for the coupling and detachment.

2 Claims, 13 Drawing Sheets

DUAL MECHANISM LOCK

BACKGROUND OF THE INVENTION

1. Field of the Invention

The present invention relates to a dual mechanism lock, particularly to a lock structure that simultaneously comprising two mechanisms: a combination lock mechanism and a key lock mechanism.

2. Description of the Prior Art

In FIG. 1, a prior-art dual mechanism lock structure comprises a lock body 1*a*, and the lock body 1*a* further comprises a combination lock structure 2*a* and a key lock mechanism 3*a*, wherein an axle 21*a* of the combination lock structure 2*a* directly passes through the key lock 3*a*, and couples to the lock core 31*a* such that the coupling and detachment actions can be performed between the axle 21*a* and the lock core 31*a*. There are difficulties in the manufacturing of such lock, because the lock core of each key lock working together with the combination lock has to be specially made such that its lock core can operate with the combination lock. It makes the structure of the lock core more complicated.

In view of the shortcomings of the prior art mentioned above, which are the subjects of improvements for a long time, hence the inventor of the present invention based on years of experience accumulated from the engagement in the related industry conducted extensive research to provide a more practical lock, resolved the foregoing shortcomings, and invented the present invention.

Therefore, the primary objective of the present invention is to provide a dual mechanism lock comprising a lock body, which simultaneously has two lock mechanisms: a combination lock mechanism and a key lock mechanism. The user just needs a set of numbers for unlocking the combination lock or a key for unlocking the key lock, and thus gives a more convenient way of application. The present invention is characterized in that the combination lock mechanism works together with the fixing plate and produces an indirect control to the lock tongue, and will not influence the key lock mechanism by directly controlling the lock tongue, and working with the recession of the external cylinder of the key lock structure, thereby the rotary motion can accomplish the reset for the combination numbers.

To attain the foregoing purpose, the structure of the present invention comprises a lock body in which a combination lock is disposed; a key lock having an internal cylinder and an external cylinder, and a fixing plate is disposed in the combination lock structure, such that a lateral side of the fixing plate is embedded into a fixing groove on the external cylinder; the combination lock structure having a plurality of combination wheels pivotally coupled to the lock core rod which supports the periphery surface of the external cylinder; a spring is disposed between the other end of the lock core rod and the lock body; each combination wheel is coupled to an elastic latch plate; the lock body is covered by a panel, thereby the internal cylinder is protruded from the panel and the panel is coupled to a knob; the surface of the knob has a keyhole; a sliding member is corresponsive to the coupling and detachment of the inner groove of the external cylinder, and the lock core rod and the combination wheels control the coupling and detachment of the fixing plate and the external cylinder, or the key via the internal cylinder generates the movement for the coupling and detachment, and the external cylinder by itself can release the pressing of the lock core rod, and reset the numbers of the combination wheels.

To make it easier for our examiner to understand the objective of the invention, structure, innovative features, and performance, we use a preferred embodiment together with the attached drawings for the detailed description of the invention.

DESCRIPTION OF THE PREFERRED EMBODIMENT

Figure 1:
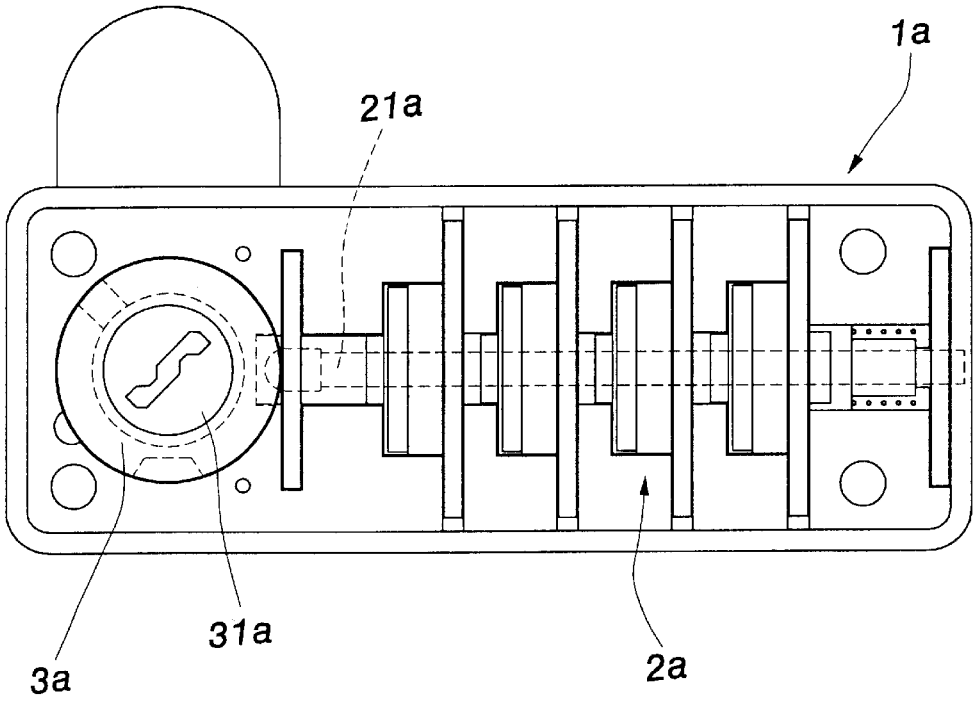
FIG. 1 PRIOR ART
FIG. 1 is a front elevation view of the prior-art structure.

Please refer to FIG. 2 to FIG. 8. The dual mechanism lock of the present invention comprises a lock body 1, lock tongue 11, a combination lock mechanism 2, a fixing plate 4, a key lock structure 3 and panel 5, wherein an end surface of the lock body has an opening 13, and a first accommodating groove 14 and a second accommodating groove 15 are disposed at the opening 13, and a penetrating hole 16 is disposed at a location proximate to the bottom of an inner peripheral surface of the second accommodating groove 15. In another embodiment shown in FIG. 3A, the penetrating hole 16*a* is disposed at the inner bottom of the second accommodating groove 15.

Figure 3:
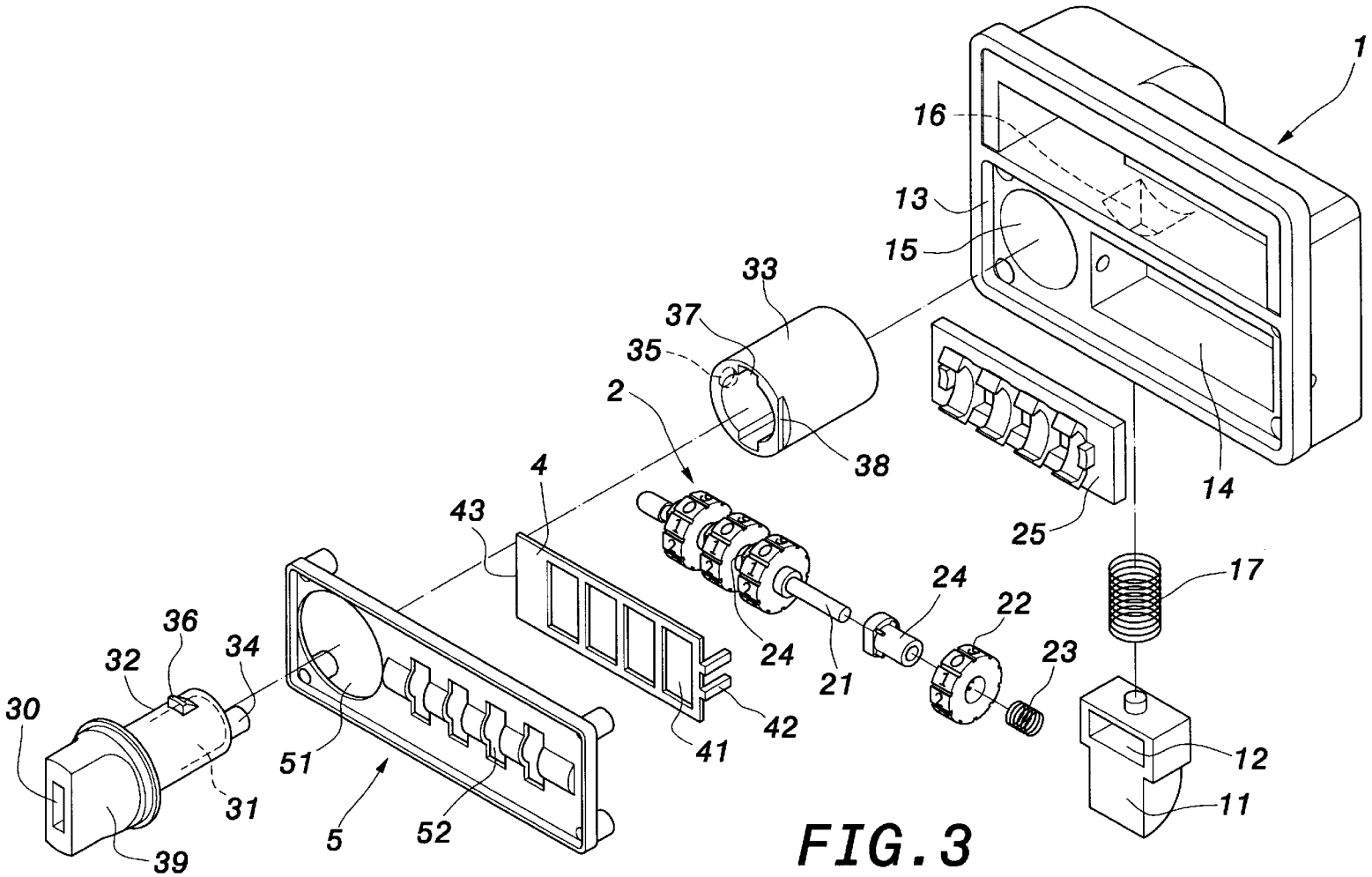
FIG. 3 is an exploded perspective view showing the parts of the dual mechanism lock structure of the present invention.
Figure 3A:
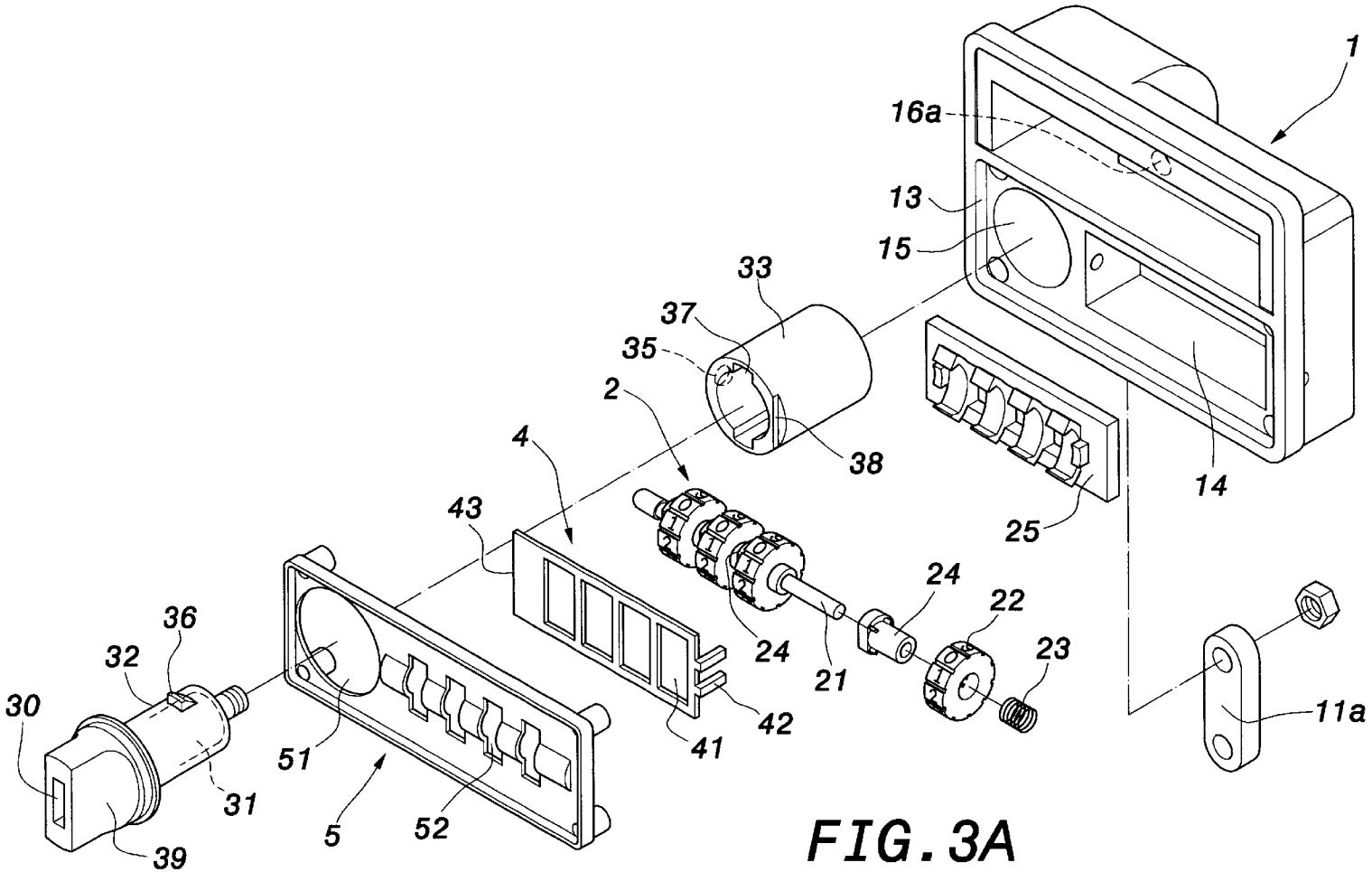
FIG. 3A is an exploded perspective view showing the parts of an alternate embodiment of the present invention.

The lock tongue 11 as shown in FIG. 3 is inserted through the penetrating hole 16 of the lock body 1, and a fixing groove 12 is disposed on the lock tongue 11, and the lock tongue 11 has a second spring 17 disposed between the end surface connecting the lock body 1 and the bottom surface inside the penetrating hole 16 of the lock body 1, and another embodiment shown in FIG. 3A has a lock tongue 11*a* in the shape of a rod, and being connected to the outer surface of the penetrating hole 16*a*.

The combination lock mechanism 2 is disposed in the first accommodating groove 14 of the lock body 1, comprising a fixing plate 4 and a lock core rod 21, the lock core rod 21 is pivotally coupled to a plurality of combination wheels 22, and the top of the lock core rod 21 presses against the peripheral surface of the first accommodating groove 14, and the other end of the lock core rod 21 is coupled to the key mechanism 3, and a first spring 23 is disposed between an end of the lock core rod 21 and an inner side of the first accommodating groove 14.

Each combination wheel 22 is fixed to the lock core rod 21 by a fixing wheel 24, and the combination wheel 22 can move the fixing wheel 24 and produce a coupling or detachment movement to the lock core rod 21. The fixing plate 4 has a plurality of groove holes 41 with the same quantity as the combination wheels 22, and each of the groove holes 41 allows part of the combination wheel 22 to pass through, and the fixing plate 4 has a pair of clips 42, and the fixing plate 4 is fixed to the lock core rod by the clips 42 such that the fixing plate 4 moves with the lock core rod 21, and the elastic latch plate 25 is coupled to the inner bottom of the first accommodating groove 14, and an elastic latch plate 25 latches each combination wheel 22. When the numbers of the combination wheel 22 are matched, the fixing wheel 24 pushes the lock core rod 21 and brings the fixing plate 4 into action.

Figure 6:
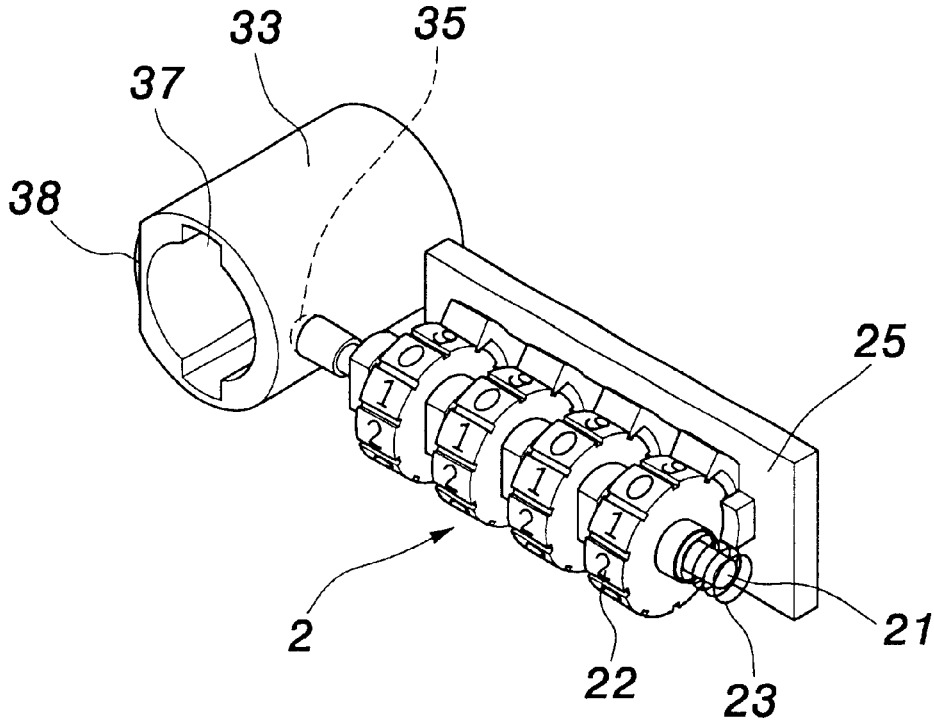
FIG. 6 is a perspective view of the lock structure as shown in FIG. 5 when the numbers of the combination lock are changed.
Figure 7:
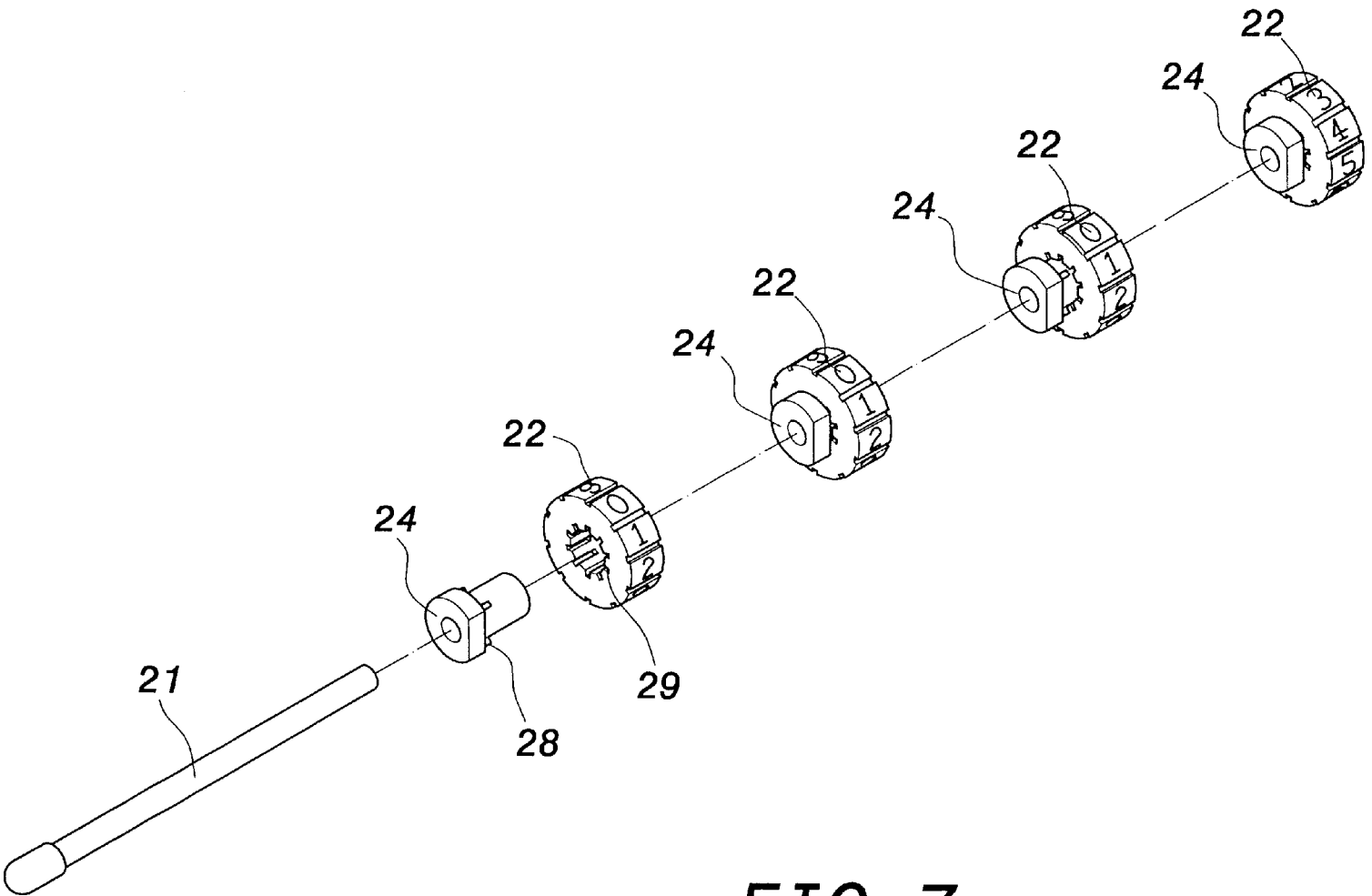
FIG. 7 is a perspective view of the fixing wheel and the combination wheel of the present invention.
Figure 7A:
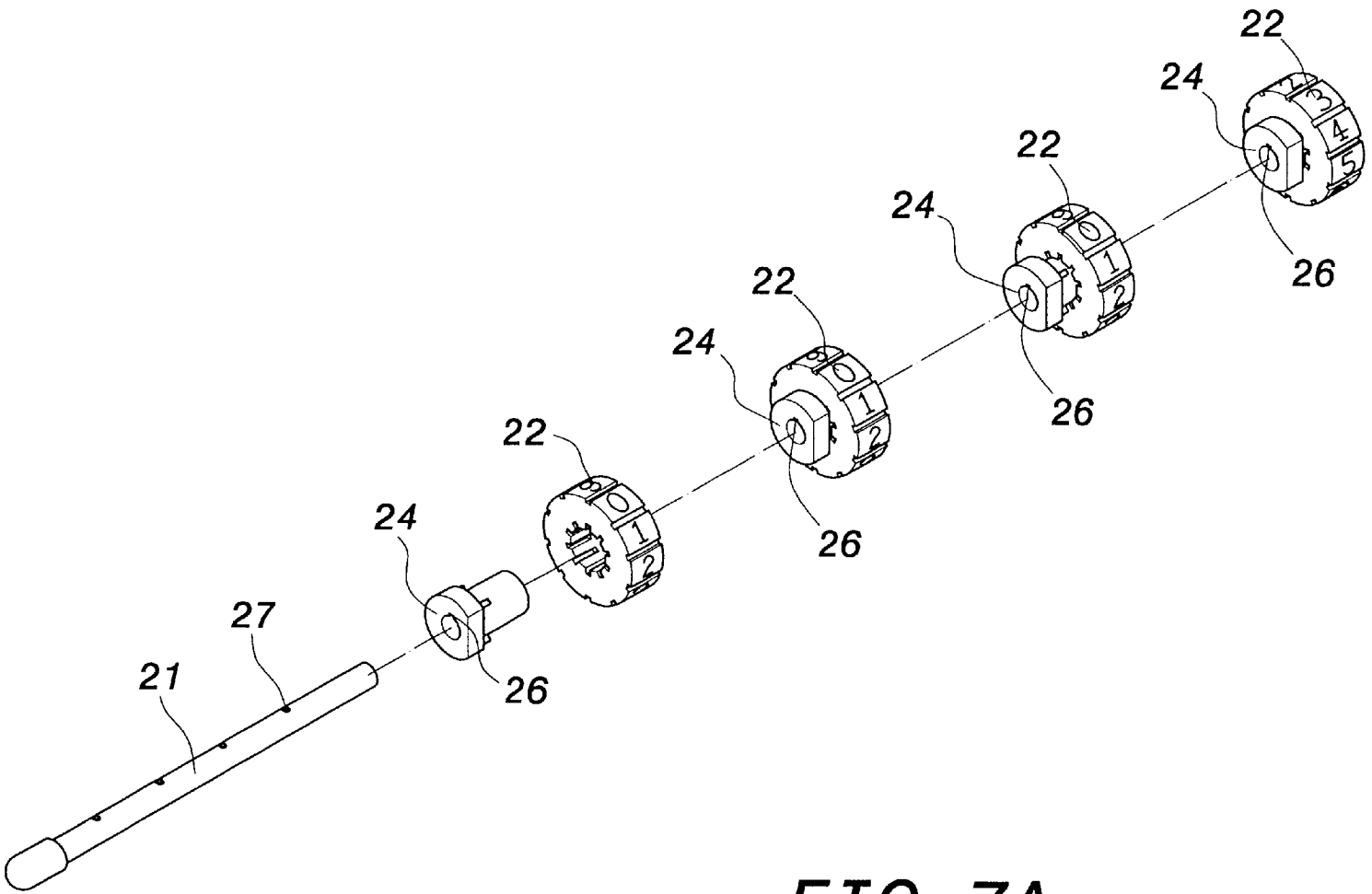
FIG. 7A is a perspective view of the lock core rod as shown in FIG. 7 having an installed protruded member according to the present invention.
Figure 8A:
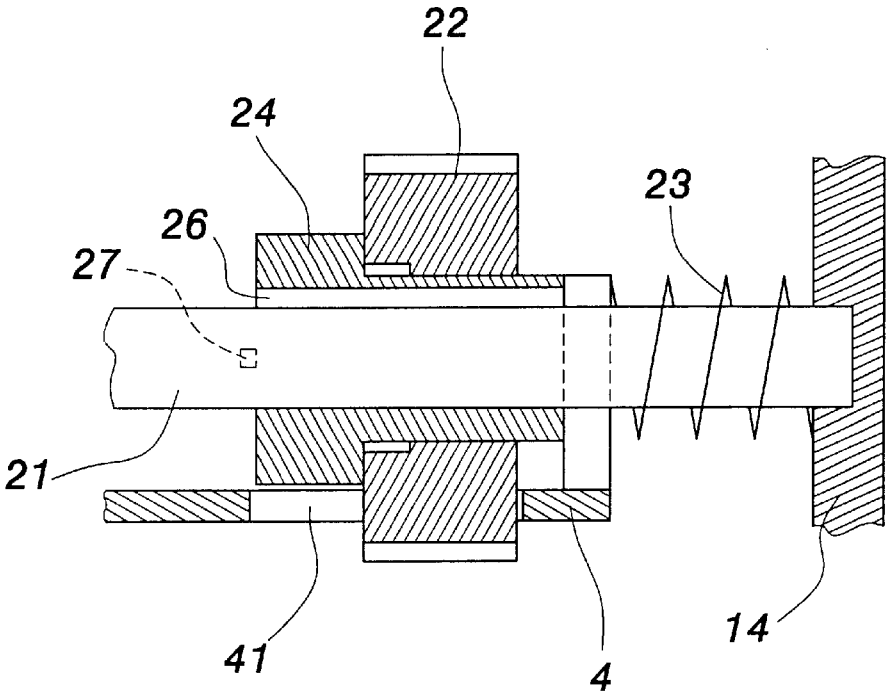
FIG. 8A is a partially cross-sectional diagram schematically showing the mechanism of a single fixing wheel set and lock core rod, and the fixing plate, when it is locked.
Figure 8B:
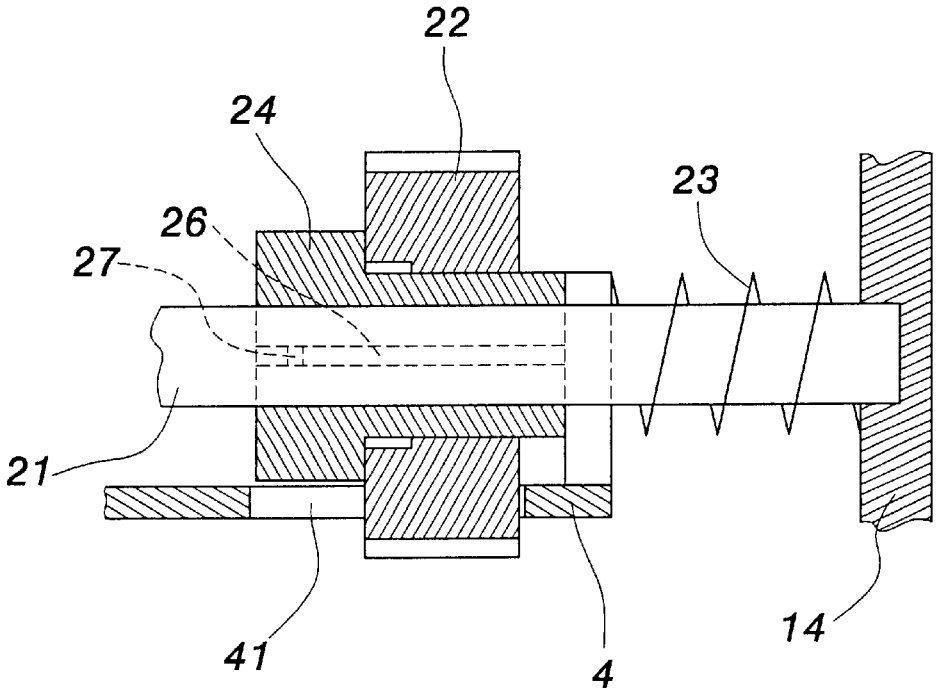
FIG. 8B is a partially cross-sectional diagram schematically showing the mechanism of a single fixing wheel set and lock core rod, and the fixing plate, when it is unlocked.

The fixing wheel 24 has a coupling and detachment mechanism, as shown in FIGS. 8A and 8B. When the lock core rod 21 is totally released by the combination wheel 22, the coupling and detachment structure (protruded members 27 and concave grooves 26) allows the lock core rod 21 to be free to slide from the position against the external cylinder 33, and the combination wheels 22 to rotate relative to the fixing wheels 24, that allows the combination wheels to be reset to different locking numbers, as shown in FIG. 6. One end of the lock core rod 21 presses against the external cylinder 33 and is rotated by the inner cylinder to rotate through half a circle (as shown in FIG. 6) such that the recess 35 of the external cylinder 33 is contacted by the lock core rod 21 to release the bias of the first spring 23 on the lock core rod 21. The coupling and detachment mechanism has a concave groove 26 on the fixing wheel 24, and a plurality of the protruded members 27 on the lock core rod 21 as shown in FIG. 7A. The external peripheral surface of the fixing wheel 24 has an embedded bar 28 corresponding to each number of the combination wheel 22, and a serrated groove 29 corresponding to each number disposed on the inner peripheral surface of the combination wheel 22, such that the embedded bar 28 and the serrated groove 29 are coupled together.

When the numbers have been changed, the embedded bars 28 will rotate with the combination wheels 22 according to different numbers and are fixed to different serrated grooves 29, and then the external cylinder 33 is rotated back to the original position, and completes the reset function.

Figure 4:
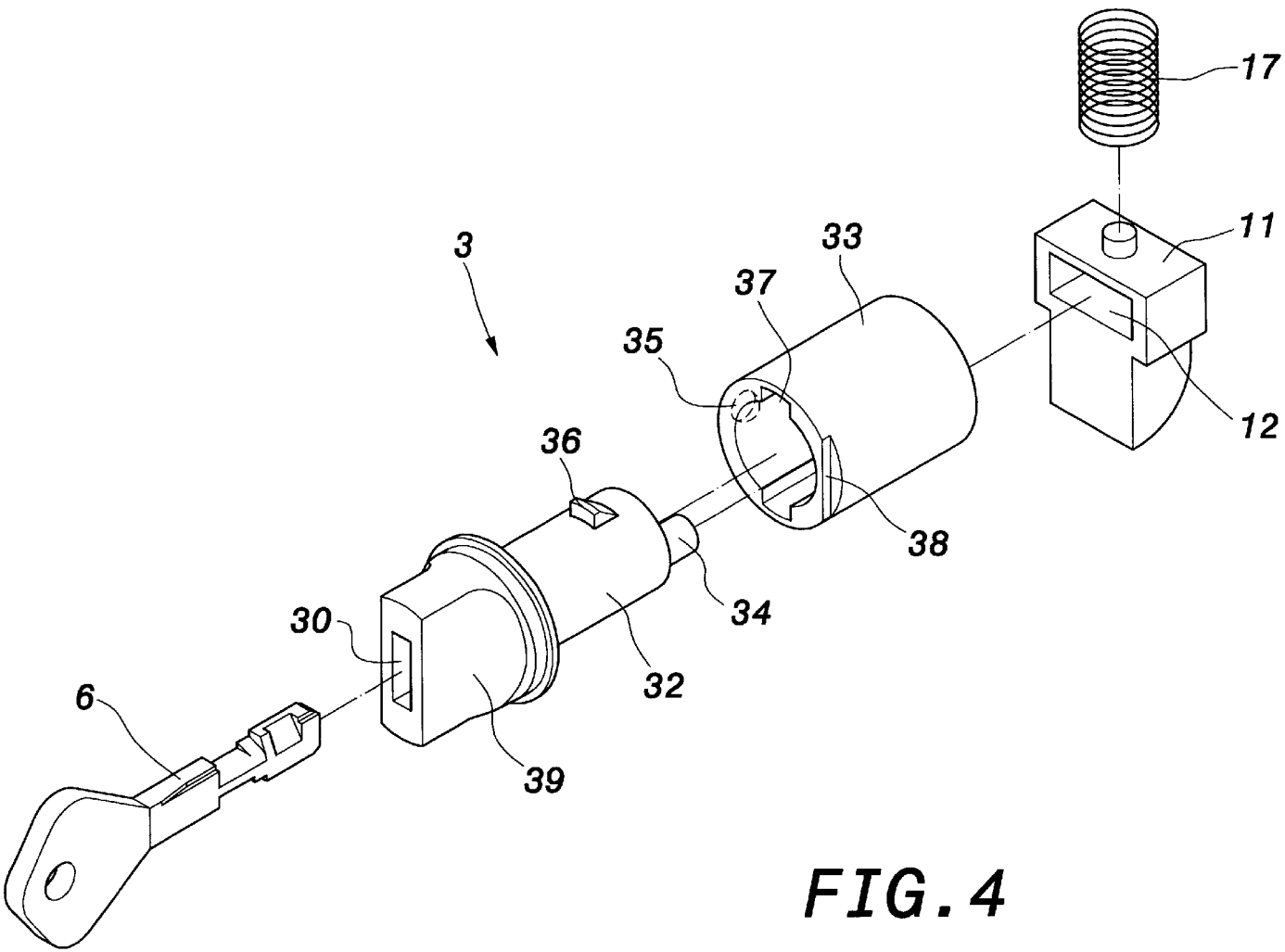
FIG. 4 is an exploded perspective view showing the parts of the key lock mechanism according to the present invention.

The key lock structure 3 as shown in FIG. 3 and FIG. 4 is disposed in the second accommodating groove 15 of the lock body 1, comprising an internal cylinder 32 and the external cylinder 33, and the external cylinder 33 is a passing-through cylinder, and the inner cylinder 32 passes through the external cylinder 33, and a lock core 31 is in the internal cylinder 32. A protruded member 34 extends from the end surface of the internal cylinder 32 such that the protruded member 34 extends into the fixing groove 12 of the lock tongue 11 (as shown in FIG. 3), and a contractible sliding member 36 is protruded from the inner end of the peripheral surface of the internal cylinder 32. The sliding member 36 is extended and retracted by lock core 31, and at least one guiding groove 37 is disposed in the inner surface of the external cylinder 33 such that the sliding member 36 can enter into the guiding groove 37 as the internal cylinder 32 rotates. The sliding member 36 couples the internal cylinder 32 to the external cylinder 33 so that they rotate together. A fixing groove 38 is disposed on the peripheral surface of the external cylinder 33, and the fixing groove 38 allows a lateral side 43 of the fixing plate 4 to be embedded into it. The fixing plate 4 restricts the rotation of the internal cylinder 32 by controlling the coupling and detachment with the fixing groove 38 of the external cylinder 33. In FIG. 3A, the protruded member 34 extends out from the penetrating hole 16*a*, and produces a locking state between the protruded member 34 and the lock tongue 11*a*.

A panel 5 covers the lock body 1, having a surface with an opening 13 of a first accommodating groove 14 and a second accommodating groove 15. The panel 5 has a penetrating hole 51, and the penetrating hole 51 allows the internal cylinder 32 to insert into its inner end, and the external end of the internal cylinder 32 has a knob 39. The end surface of the knob 39 has a keyhole 30, and the panel 5 has a plurality of adjusting windows 52 having the same quantity as that of the combination wheels 22, and allows the combination wheel to protrude from the panel.

Figure 4A:
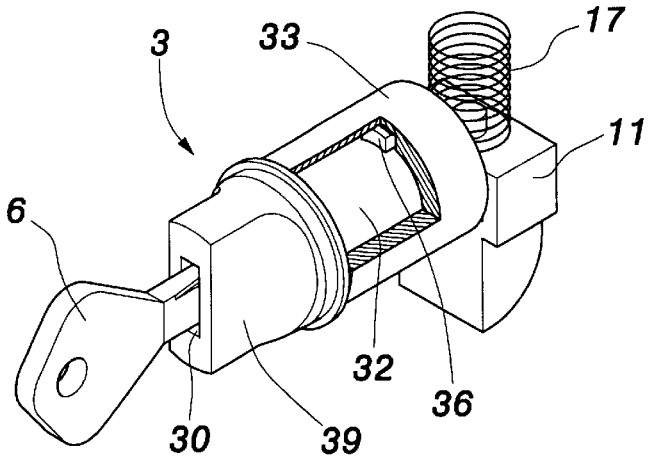
FIG. 4A shows a partial cutaway view of the key lock mechanism of FIG. 4 after the lock is assembled but it is not in action.
Figure 4B:
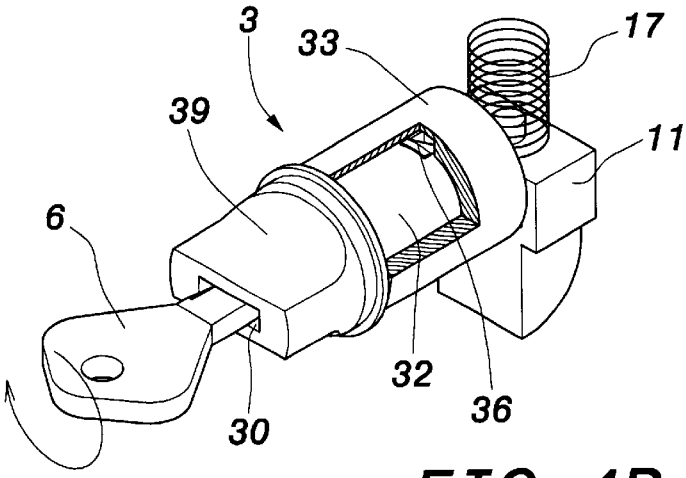
FIG. 4B shows a partial cutaway view of the key lock mechanism of FIG. 4 after the lock is assembled and is rotated in action.
Figure 4C:
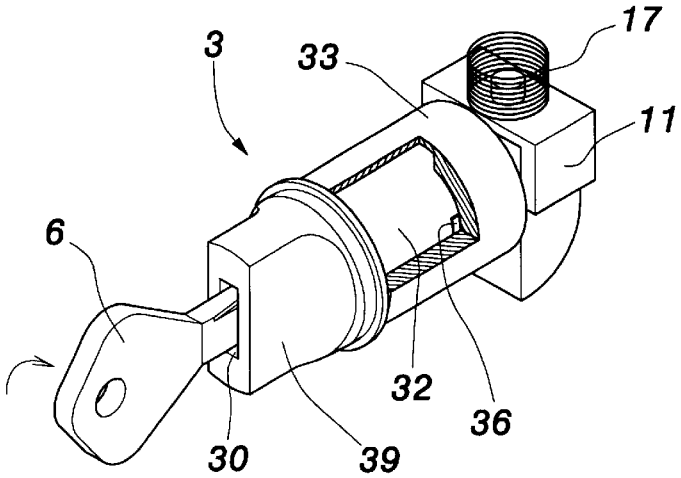
FIG. 4C shows a partial cutaway view of the key lock mechanism of FIG. 4 after the lock is assembled and is rotated to bring the internal cylinder in action to move the lock tongue.

From FIG. 4A to FIG. 4C, when a key 6 is inserted into the keyhole 30, it engages the lock core 31 of the internal cylinder 32 from rotation form the position shown in FIG. 4A. The sliding member 36 of the internal cylinder 32 is latched to the guiding groove 37 of the external cylinder 33. As the key 6 is rotated to 270 degrees (the state shown in FIG. 4B, and the rotation is not limited to only such angle), the key rotates the lock core relative to the internal cylinder. That rotation of the lock core relative to the internal cylinder will not displace the lock tongue 1, and the spring 17 will not be compressed. As shown in FIG. 4C, when the internal cylinder 32 is rotated, the internal cylinder 32 directly moves the lock tongue 11 disposed inside the penetrating hole 16 of the lock body 1 to unlock the lock. At that time the spring 17 will have been compressed by the upward movement of the lock tongue 11. Similarly, when the lock core 31 is locked by the key, the sliding member 36 couples the internal cylinder 32 to the external cylinder 33, and the external cylinder 33 restricts the rotation of the internal cylinder 32 and allows the lock tongue 11 to be displaced by the spring 17. The same rotative motion is applicable to the embodiment shown in FIG. 3A, to rotate the lock tongue 11*a*, and will not be described any further.

Figure 5:
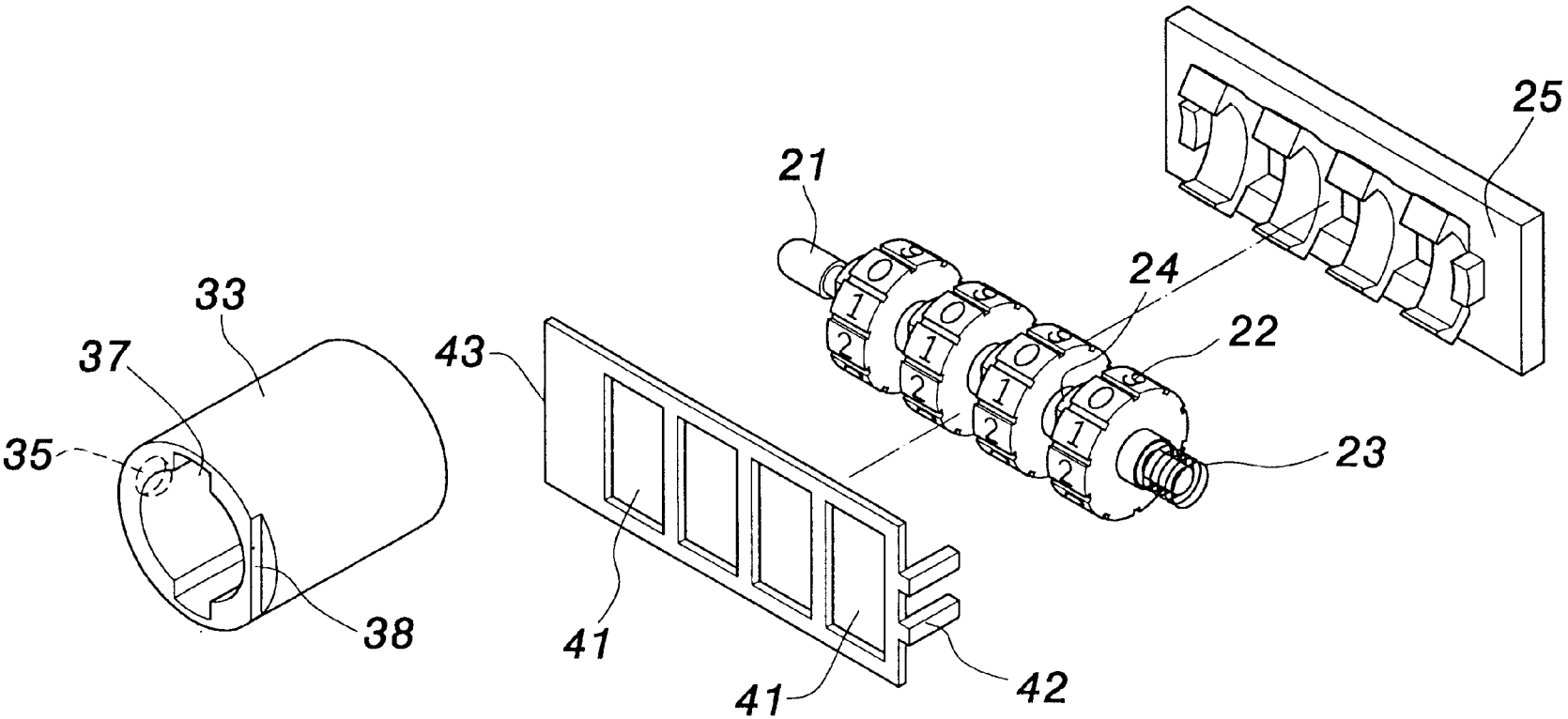
FIG. 5 is an exploded view of the combination lock mechanism of the present invention.
Figure 5A:
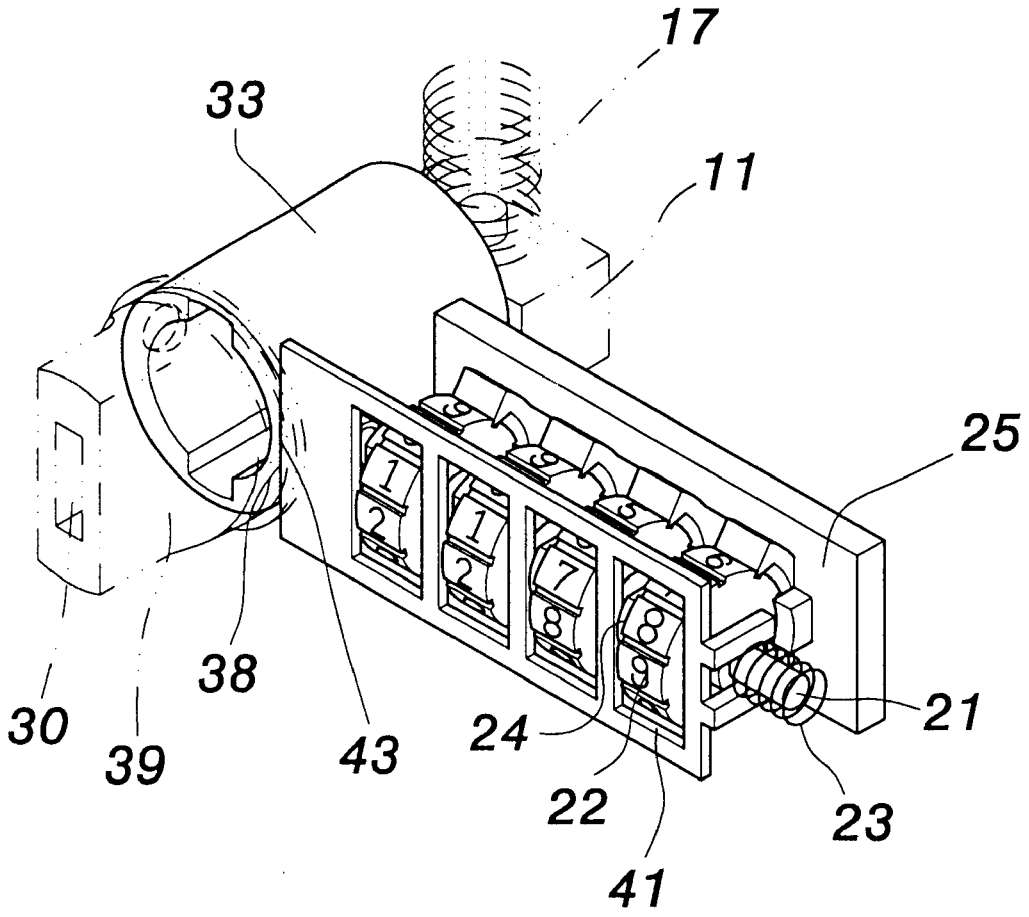
FIG. 5A is a perspective view of the lock structure as shown in FIG. 5 after the combination lock is locked.
Figure 5B:
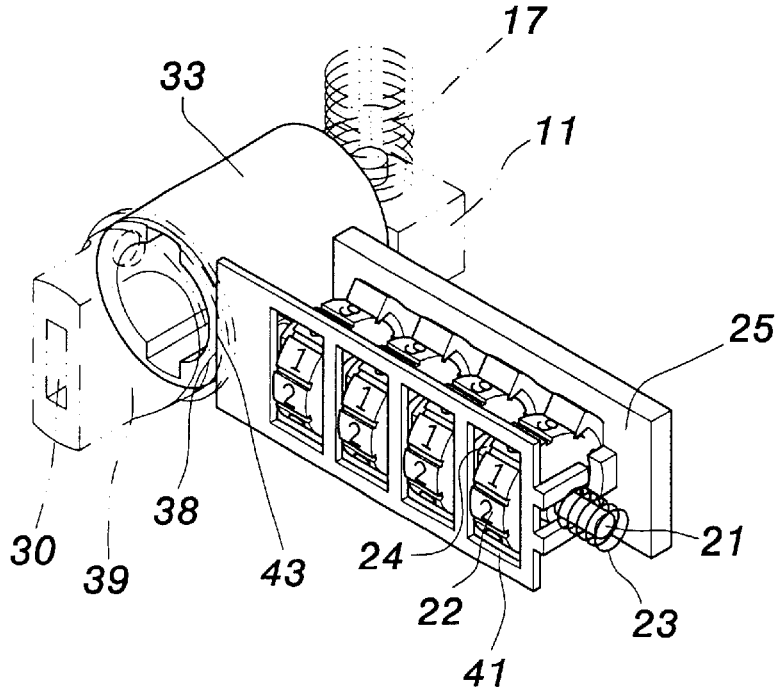
FIG. 5B is a perspective view of the lock structure as shown in FIG. 5 after the combination lock is unlocked.
Figure 5C:
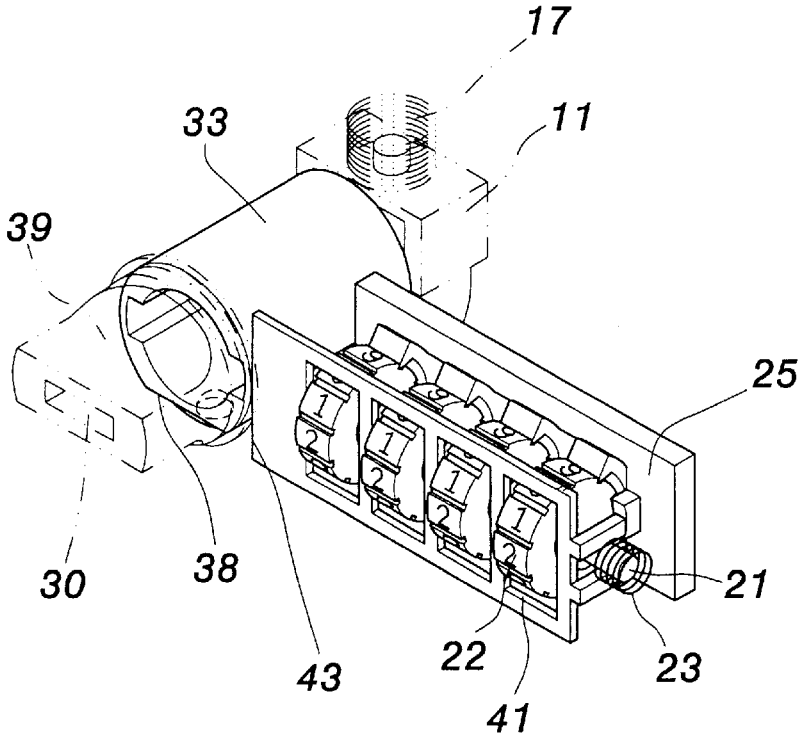
FIG. 5C is a perspective view of the lock structure as shown in FIG. 5 when the lock is not locked, and brings the internal cylinder in action to move the lock tongue.

Furthermore, when each combination wheel 22 performs the locking as shown in FIG. 5A, the lock core rod 21 and the fixing plate 4 move simultaneously, so that the fixing plate 4 is latched to the external cylinder 33. At that moment, the numbers of the combination are not in order. For example, if the numbers of the combination are set to be 2222 as shown in FIG. 5B, the combination lock structure 2 releases the latching of the fixing plate 4, and the lock core rod 21 and the fixing plate 4 are simultaneously freed from the latched position. Since the movement of the fixing plate 4 is insignificant, it is not easily seen in the figure. However, we can see the change in the numbers, and then the external cylinder 33 can be rotated. Since the external cylinder 33 and the internal cylinder 32 are integrated into one piece, therefore the spring 17 will be compressed and the lock tongue displaced, as shown in FIG. 5C. The knob 39 rotates the internal cylinder 32 to rotate the external cylinder 33 (as described in the previous section) and move the lock tongue 11 back into the penetrating hole 16 of the lock body 1, completing the unlocking action.

Figure 2:
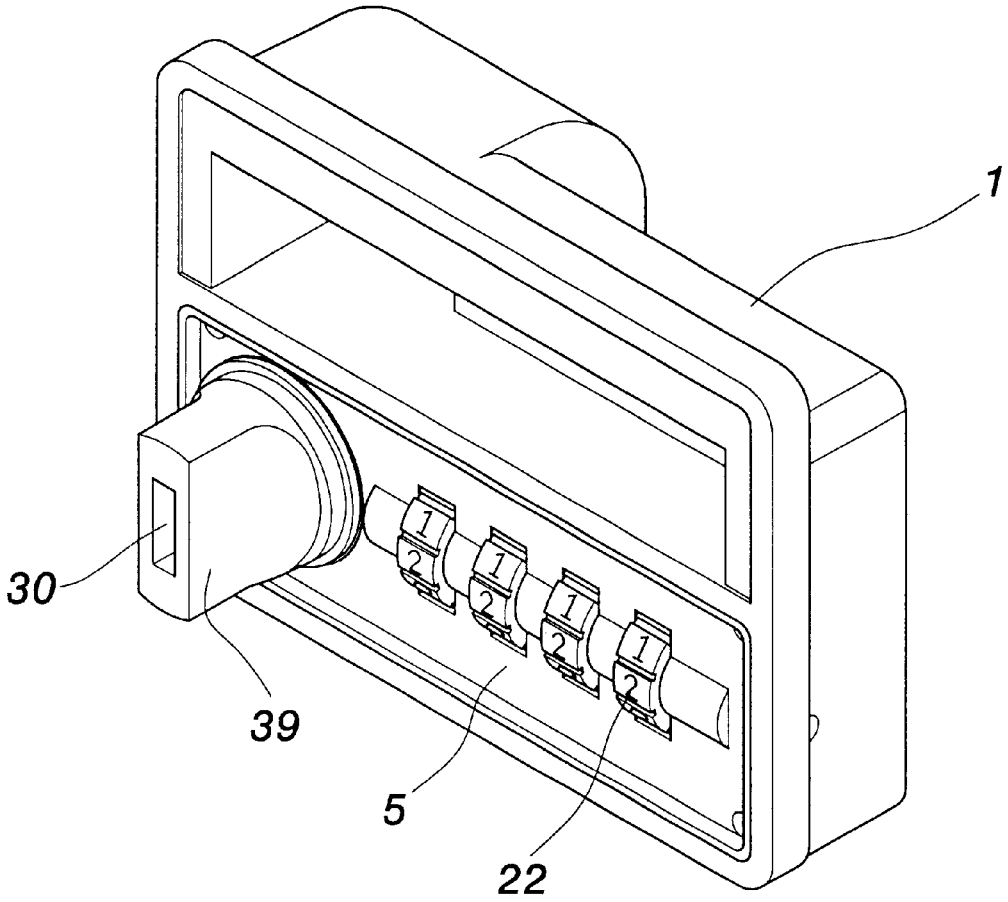
FIG. 2 is a perspective view of the present invention.

In view of the foregoing structure, the design of the fixing plate applied to the present invention can be used together with any kinds of combination locks and key locks. In other words, the fixing plate and the external cylinder work together and completes the locking and unlocking of the combination lock. The external cylinder, the internal cylinder, and the lock core work together to complete the locking and unlocking of the key lock. The two lock mechanisms are independent, and can be implemented individually. In addition, the lock tongue of the present invention can work with the implementation of the internal cylinder of the key lock and can have many different configurations. Similarly, the external look of the lock body can also have different change as shown in FIG. 2. The lock body has an empty groove that enables the user to hold the lock body easily. Furthermore, the combination lock of the present invention also provides the function of resetting numbers to raise the security. Therefore the present invention provides excellent practicability, which is totally different to the prior-art structure.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual mechanism lock, comprising:

a lock body having an opening formed therein, said lock body having adjacent first and second accommodating grooves formed in said opening;

a key lock structure positioned in said second accommodating groove, said key lock structure including a) an external cylinder having a tubular contour rotatably disposed in said second accommodating groove, said external cylinder having an internal surface with at least one guiding groove formed therein, said external cylinder having a fixing groove formed on one side thereof and a recess formed in an opposing side, b) an internal cylinder located in said external cylinder and having a sliding member engageable with said guiding groove for rotation of said external cylinder with said internal cylinder, said internal cylinder having a protruded member extending from an one end thereof and an opposing end coupled to a knob, and c) a lock core disposed in said internal cylinder and being rotatable therein to retract said sliding member from engagement with said guiding groove responsive to insert and rotation of a key therein to thereby rotate said internal cylinder relative to said external cylinder;

a lock tongue slidably disposed in a penetrating hole of said lock body and biased by a first spring, said lock tongue having a fixing groove formed therein, said protruded member of said internal cylinder being received in said fixing groove to displace said lock tongue within said penetrating hole responsive to rotation of said internal cylinder;

a combination lock mechanism disposed in said first accommodating groove, said combination lock mechanism including a) a lock core rod slidably disposed in said first accommodating groove and having a plurality of protruded members extending therefrom, b) a plurality of fixing wheels rotatably coupled to said lock core rod, each of said fixing wheels having a concave groove for slidably receiving a respective one of said plurality of protruded members of said lock core rod therein responsive to said fixing wheels being rotated to an unlocking position where said concave grooves of said fixing wheels are respectively aligned with said plurality of protruded members of said lock core rod, said lock core rod being biased by a second spring to respectively position said plurality of protruded members external to said concave grooves of said fixing wheels, c) a plurality of combination wheels respectively mounted to said plurality of fixing wheels for rotation therewith, and d) a fixing plate disposed in said first accommodating groove and having a first lateral side disposed in said fixing groove of said external cylinder, said fixing plate having a pair of clips formed on second lateral side thereof, said fixing plate being fixed to said lock core rod by said pair of clips for displacement therewith; and, a panel covering said lock body and having openings formed therethrough for passage of a portion of said combination wheels and said knob therethrough, wherein said fixing plate locks said external cylinder against rotation until said fixing wheels are rotated to said unlocking position and said fixing wheels being respectively separable from said plurality of combination wheels for resetting a combination defined thereby responsive to said external cylinder being rotated to align said recess therein with an end of lock core rod for receiving said end of said lock core rod therein.

2. The dual lock mechanism lock structure as recited in claim 1, wherein said combination lock mechanism includes an elastic latch plate disposed in said accommodating groove for elastically engaging said plurality of combination wheels.

* * * * *